United States Patent [19]

Rose

[11] Patent Number: 4,510,774

[45] Date of Patent: Apr. 16, 1985

[54] CONTROL DEVICE FOR A KNITTING MACHINE

[75] Inventor: Wolfgang Rose, Karl Marx Stadt, German Democratic Rep.

[73] Assignee: VEB Kombinat Textima, German Democratic Rep.

[21] Appl. No.: 564,227

[22] Filed: Dec. 21, 1983

[30] Foreign Application Priority Data

Dec. 27, 1982 [DD] German Democratic Rep. ... 246604

[51] Int. Cl.[3] ..... D04B 7/00; D04B 15/00

[52] U.S. Cl. ..... 66/75.2; 66/232; 364/470

[58] Field of Search ..... 66/75.2, 232, 231; 364/470

[56] References Cited

U.S. PATENT DOCUMENTS 4,167,861 9/1979 Krause et al. ..... 66/75.2

FOREIGN PATENT DOCUMENTS 1044337 5/1959 Fed. Rep. of Germany .

2658588 1/1980 Fed. Rep. of Germany .

*Primary Examiner*—Ronald Feldbaum

*Attorney, Agent, or Firm*—Michael J. Striker

[57] ABSTRACT

In a control device for a knitting machine including a number of knitting carriages running in a knitting circle in a needle bed, a stationary control part and a movable control part are provided. Both control parts operate during the entire knitting process independently from each other. The stationary control part stores information data from stationary components of the machine and the movable control part stores information data for pattern cords of one or several knitted pieces. The application of the data into the movable control part is effected by a cable from a special laser or the stationary control part when the knitting machine is in the inoperative position. The transmission of the data from the movable control part to the running knitting carriages to cause a selection of individual needles over the whole range of knitting and also changes in functions of the running carriages is effected by a cable which connects the movable control part to the running carriages.

1 Claim, 1 Drawing Figure

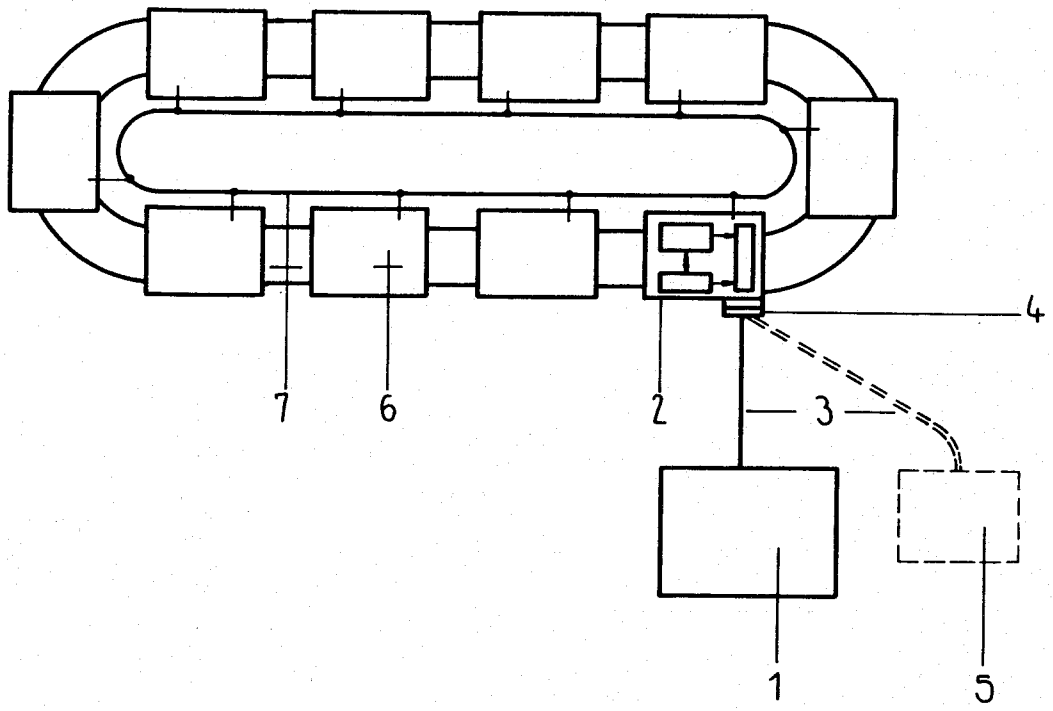
1
2
3
4
5
6
7

CONTROL DEVICE FOR A KNITTING MACHINE

BACKGROUND OF THE INVENTION

The present invention pertains to a control device for a knitting machine. More particularly, this invention relates to a control device including data processing units and operative for transmitting, storing and processing the information required for a knitting process in automatically operated knitting machines.

Even more particularly, the present invention relates to a control device for a flat knitting machine including a plurality of knitting carriages running in one direction, but can also be employed with a flat knitting machine with back and forth movable carriages or with a circular knitting machine.

The control devices of the foregoing type include a stationary control part connected with stationary components of the machine and a movable control part connected to the movable knitting carriages.

One of the knitting machines with continuously running carriages is disclosed in applicant's pending application Ser. No. 440,029.

German patent publication DE-OS 2,658,588 discloses a control device for a wireless transmission of data of the stationary control part to the movable control part in the flat knitting machine. In the reference device, one or more transmitters are connected with a data carrier, which cooperate with a data receiver mounted on each individual knitting carriage. One or more transmitters are located outside of needle spaces. The data transmitters send their impulses or signals along the transmission area, which signals are received by the receivers of one or a number of knitting carriages. The received data are processed in a microprocessor and other control unit installed on or associated with each knitting carriage. The data carrier and knitting carriages are provided with special structural elements and constructions for protection and screening of the transmission area against a foreign influence. Optical, acoustic and electro-magnetic elements serve for transmitting information data.

The disadvantage of this wireless transmission is that, due to various environmental influences, this transmission is extremely troublesome. This known control device is extremely complex technically and costly because it should be protected against a foreign influence and due to a required frequency separation of a plurality of signals involved.

SUMMARY OF THE INVENTION

It is an object of the present invention to provide an improved control device for controlling functions of the knitting carriages of the knitting machine.

It is another object of the present invention to provide a control device for a knitting machine, in which the reliable transmission, storage and processing of information data for a knitting process would be ensured.

Still another object of the invention to improve known control devices comprised of a stationary control part and a movable control part so that interference of the control with a foreign inflow would be excluded and that the needles would be selected individually over the entire knitting area of the needle bed and the functions of the knitting carriages within one knitting circle would be changeable.

These and other objects of the invention are attained by a control device for a knitting machine including stationary structural components and a plurality of carriages adapted to run in a knitting cycle over a predetermined path and provided with control elements for controlling functions of the carriages, the control device comprising a stationary control part and a movable control part movable together with at least one of said carriages, each of said control parts being provided with a microprocessor and data processing units, said stationary and movable control parts being both operated during the entire knitting process independently from each other, said stationary control part storing information data for the stationary structural components, said movable control part storing information data for pattern cords of at least one knitted piece; a first cable; a special laser, said first cable connecting said movable control part selectively with the laser or with the stationary control part so that an application of the information data to the movable control part is effected from said laser or said stationary control part through said first cable; and a second cable connecting said movable control part to at least one of said carriages so that information data are transmitted from said movable control part to the control elements of said carriages for a selection of needles in accordance with required patterns and for changing functions of said carriages.

Thus the application of the data for the movable control part is realized from a special laser through a cable while the machine is in the inoperative position or from the stationary control part. The movable control part is connected to one or a plurality of the knitting carriages through a flexible cable for transmitting data for selecting the needles according to knitting patterns.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

The sole FIGURE of the drawing illustrates a schematic view of the carriages of a flat knitting machine in conjunction with a control device according to the invention.

DETAILED DESCRIPTION OF THE PREFERRED EMBODIMENTS

With reference to the drawing, a plurality of carriages 6 are shown in the schematic top plan view of the flat knitting machine, which carriages continuously run over an oval path in a knitting bed. The control device of the knitting machine, which enables a reliable transmission, storage and processing of data of information for a knitting process, comprises a control part 1 which is stationary and a movable control part 2. The stationary control part 1 stores information data for the stationary components of the knitting machine whereas the movable control part 2, which runs together with knitting carriages 6, stores information data for a selection of individual needles according to patterns and for certain functions of the carriages. The application of data into the movable control part 2 takes place for one or more knitted pieces during the standstill of the knitting machine via a cable 3 and plug 4 from a special laser 5 or the stationary control part 1. Cable 3 is separated from plug 4 before the beginning of the knitting process, and after the completion of the information data transmission to the movable control part 2.

Each of the control parts 1 and 2 is provided in the known fashion with a current supply unit, a microprocessor, input and output unit for structural components of the machine and RAM and ROM memories. The information data are applied from the movable control part 2 to the knitting carriages 6 by a flexible cable 7. Each carriage 6 is provided with interface structural components, a time signal generator and final control elements. The final control elements cause a selection of the knitting needles corresponding to the required patterns as well as corresponding adjustments of the functions of the knitting carriages, in accordance with an incomming signal.

The current supply of the movable control part 2 is realized through known sliding contacts and this movable part is also provided in the known manner with special switches or batteries for stabilizing the voltage The transmission of pattern and control information contained in the RAM-memory, which is obtained from the microprocessor on the movable control part 2 and synchronized via the time signals by means of the machine program provided in the ROM-memory, is realized on each individual carriage. The interface subassemblies or structural components of the carriages 6 provide for an intermittent taking over (buffer) and amplifying (driver) of pattern-and-control signals. The time signal generator delivers signals for the synchronization of the timely issuance of the information transmission and information output. The information exchange between the movable control part 2 and carriages 6 takes place by means of cable 7 via a bus system in a bit-series or bit-parallel fashion.

It will be understood that each of the elements described above, or two or more together, may also find a useful application in other types of control devices for knitting machines, differing from the types described above.

While the invention has been illustrated and described as embodied in a control device for a knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A control device for a knitting machine including stationary structural components and a plurality of carriages adapted to run in a knitting cycle over a predetermined path and provided with control elements for controlling functions of the carriages, the control device comprising a stationary control part and a movable control part movable together with at least one of said carriages, each of said control parts being provided with a microprocessor and data processing units, said stationary and movable control parts being both operated during the entire knitting process independently from each other, said stationary control part storing information data for the stationary structural components, said movable control part storing information data for pattern cords of at least one knitted piece; a first cable; a special laser, said first cable for connecting said movable control part with the laser and the stationary control part so that an application of the information data to the movable control part is effected from said laser and said stationary control part through said first cable; and a second cable connecting said movable control part to at least one of said carriages so that information data are transmitted from said movable control part to the control elements of said carriages for a selection of needles in accordance with required patterns and for changing functions of said carriages whereby an application of the information data to the movable control part can be effected selectively from said laser, or said stationary control part through said first cable.

* * * * *